US009193047B1

(12) United States Patent
Hardy

(10) Patent No.: US 9,193,047 B1
(45) Date of Patent: Nov. 24, 2015

(54) WRENCH SECURING PLATE SYSTEMS

(71) Applicant: Terry Lynn Hardy, Baldwin, MD (US)

(72) Inventor: Terry Lynn Hardy, Baldwin, MD (US)

( * ) Notice: Subject to any disclaimer, the term of this patent is extended or adjusted under 35 U.S.C. 154(b) by 261 days.

(21) Appl. No.: 13/770,776

(22) Filed: Feb. 19, 2013

Related U.S. Application Data

(60) Provisional application No. 61/601,083, filed on Feb. 21, 2012.

(51) Int. Cl.
*B25B 23/00* (2006.01)

(52) U.S. Cl.
CPC ..... *B25B 23/0085* (2013.01)

(58) Field of Classification Search
USPC ..... 29/559
See application file for complete search history.

(56) References Cited

U.S. PATENT DOCUMENTS 1,941,889 A 1/1934 Freeman
3,320,836 A 5/1967 Hagerinan et al.
5,791,213 A 8/1998 Young
6,308,596 B1 10/2001 Williams
2006/0060037 A1 3/2006 Haggerty
2006/0156873 A1 7/2006 Ruiz

OTHER PUBLICATIONS www.wildwesthardware.com/slide_bolts/slide_bolts.htm. Confirmed to exist in 2007 via https://web.archive.org/.*

* cited by examiner

*Primary Examiner* — Moshe Wilensky
(74) *Attorney, Agent, or Firm* — RG Patent Consulting, LLC; Rachel Gilboy

(57) ABSTRACT

A specialty tool for holding a pipe wrench stable when assembling or disassembling piping systems. While working in the field, plumbers normally have to balance one pipe wrench on its spine, holding it either between their knees or under one foot, while using another wrench for assembling/disassembling pipes, valves and fittings. Anyone who's attempted to perform this kind of task has experienced the aggravation, frustration and time loss associated with holding and balancing wrenches in this manner which this device serves to solve.

1 Claim, 5 Drawing Sheets

WRENCH SECURING PLATE SYSTEMS

CROSS-REFERENCE TO RELATED APPLICATION

The present application is related to and claims priority from prior provisional application Ser. No. 61/601,083, filed Feb. 21, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of wrench holders, and more specifically relates to a wrench securing plate system.

DESCRIPTION OF THE RELATED ART

In a modern industrialized society, the construction field has used pipes and lines to transport all manner of medium including liquid, gas, and sewer. In order for the product to arrive at the desired destination, pipelines must be constructed from various sizes and lengths of pipe and fittings. The worker must build the pipeline using different fittings; for example, a pipe elbow may be used for making the pipeline navigate a corner before coupling to the appliance such as a hot water tank or the like. Upon joining any two pieces of pipe or fittings, the worker must apply an adhesive to insure a leak-proof connection. Many of these pipes are buried underground or in locations that may be inaccessible for long periods of time. Over a period of time these connections may become 'stuck-fast' due to many reasons, including the adhesive used, or rust caused by corrosion. When a repair is needed, the worker may find it very difficult to disconnect the array of pipes and fittings.

One method of working to fix or disassemble/assemble pipes is to attach two pipe-wrenches in opposing directions, loosening or removing the desired fitting or pipe using a counter-clockwise motion. However, as discussed previously, many of these pipes and fittings may be extremely difficult to remove. The worker may then employ the use of a "cheater-pipe", to increase leverage. A cheater-pipe is a length of pipe longer than the wrench handle, and large enough in diameter to slide over the wrench handle to dramatically increase leverage. Although this may prove useful for increased leverage; the practice may also increase the likelihood of an accident. Many accidents occur annually due to strain and wrench slippage, causing lost-time accidents. Many times, a second worker is needed or utilized to achieve the needed outcome, making it impractical, and costly for many situations and companies. A means whereby a single individual may manipulate pipes for assembly or disassembly is desirable.

Various attempts have been made to solve the above-mentioned problems such as those found in U.S. Pat. Nos. 5,791,213, 2006/0060037, 2006/0156873, 3,320,836, 1,941,889, and 6,308,596. This prior art is representative of wrench stands. None of the above inventions and patents, taken either singly or in combination, is seen to describe the invention as claimed.

Ideally, a wrench holder should provide use as a single person operation and, yet, would operate reliably and be manufactured at a modest expense. Thus, a need exists for a reliable wrench securing plate system to securely hold wrenches and to avoid the above-mentioned problems.

BRIEF SUMMARY OF THE INVENTION

In view of the foregoing disadvantages inherent in the known wrench holder art, the present invention provides a novel wrench securing plate system. The general purpose of the present invention, which will be described subsequently in greater detail is to provide a stable base in which to secure a wrench so that a user is able to manipulate a workpiece using a wrench yet not having to hold the wrench.

A wrench securing plate system is disclosed herein comprising a wrench securing plate assembly having a base plate, (with a top side having a top surface, a bottom side having a bottom surface, a first edge, a second edge, a third edge, and a fourth edge); a plurality of handle holding loops (including a first set of handle holding loops, and a second set of handle holding loops), apertures for securing the base plate to another surface, and a set of user-instructions located on the top surface for use providing a functional indicia. The plate assembly comprises a base plate, and a plurality of handle holding loops in combination. The parameters of the base plate are defined by the top side, the bottom side, the first edge, the second edge, the third edge, and the fourth edge. The base plate in preferred embodiments comprises dimensions of about 8 inches wide and about 12 inches long and about 0.0793 inches thick. The base plate and the plurality of handle holding loops preferably comprise ferrous material so as to deliver durability in rough service over an extended period. The first set of handle holding loops comprises dimensions of about 1.055 inches wide and 1½ inches long and 1.800 inches tall and 0.0793 inches thick in preferred embodiments; however other sizes may be used. The second set of handle holding loops preferably have dimensions of about 0.885 inches wide and 1 inch long and 1.380 inches tall and 0.0793 inches thick.

The top side and the bottom side are substantially planer; the bottom side of the base plate is able to be set on a flat surface for use. The plurality of handle holding loops are mounted to the top side of the base plate. The first set of handle holding loops is mounted perpendicularly to the second set of handle holding loops on the top side of the wrench securing plate assembly. The handle holding loops comprise a 3-D rectangular profile in preferred embodiments. The bottom surface is planar, thereby allowing the wrench securing plate assembly to be set securely on a flat-surface. The wrench comprises a pipe-wrench, and the wrench securing plate assembly is useful for holding a wrench in stasis via securing a handle of the wrench within at least two of the handle holding loops, such that a user is able to manipulate a workpiece using the wrench yet not having to hold the wrench. In this way the present invention 'frees' up hands of the user.

A kit is described having the wrench securing plate assembly, the plurality of handle holding loops, and at least one set of user instructions. The kit may comprise a version that is attachable to a receiver hitch. This version is portable and in certain embodiments may comprise a step with non-slip gripping surface located thereon.

A method of use for a wrench securing plate system is also disclosed herein comprises the steps of placing a wrench securing plate assembly on a flat planer surface, inserting a workpiece into the jaw opening, inserting a pipe wrench into the handle holding loops, manipulating the workpiece, removing the workpiece, removing the pipe wrench from the handle holding loops, and storing the wrench securing plate assembly.

The present invention holds significant improvements and serves as a wrench securing plate system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a wrench securing plate system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a wrench holding device and more particularly to a wrench securing plate system as used to improve the convenience of use in a single person operation.

Generally speaking, The Plumber's Plate is a specialty tool for holding a pipe wrench stable when assembling or disassembling piping systems. While working in the field, plumbers normally have to balance one pipe wrench on its spine, holding it either between their knees or under one foot, while using another wrench to assembling/disassembling pipes, valves and fittings. Anyone who's attempted to perform this kind of task has experienced the aggravation, frustration and time loss associated with holding and balancing wrenches in this manner which this present invention serves to solve.

The Plumber's Plate preferred base dimensions: 8" wide× 12" long×0.0793" thick 4⅜" drilled holes one in each corner 2 set ¾" from top/side edges and 2 set ¾" from bottom/side edges. Position of 4 metal loops on base of plate. Top loop dimensions: inside top 1.055" wide×1½" long×1.800" tall× 0.0793" thick Set ½" to front of loop from top edge and is centered from side edges Left loop dimensions: inside top 0.885" wide×1" long×1.380" tall×0.0793" thick Set 2¾" to front of loop from left edge and centered from top edge Right loop dimensions: inside top 0.885" wide×1" long×1.380" tall×0.0793" thick Set ½" to front of loop from right edge and centered from top edge Bottom loop dimensions: inside top 1.055" wide×1½" long×1.800" tall×0.0793" thick Set 4½" to front of loop from bottom edge and centered from side edge.

Figure 1:
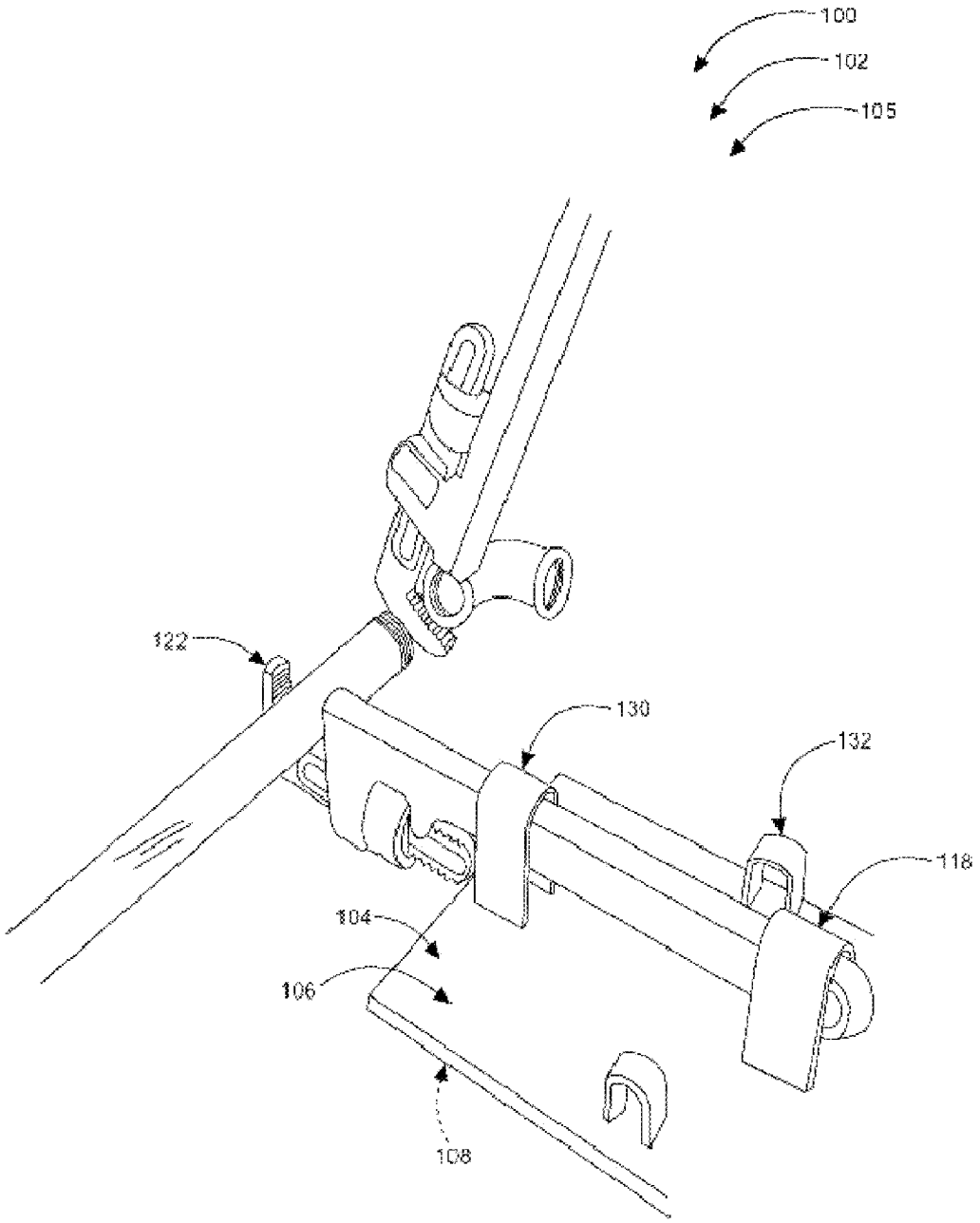
FIG. 1 shows a perspective view illustrating an in-use condition of a wrench securing plate system according to an embodiment of the present invention.

Referring to the drawings by numerals of reference there is shown in FIG. 1, a perspective view illustrating an in-use condition of wrench securing plate system 100 according to an embodiment of the present invention.

Wrench securing plate system 100 comprises wrench securing plate assembly 102. Wrench securing plate assembly 102 comprises base plate 104 having top side 106, bottom side 108, first edge 110, second edge 112, third edge 114, fourth edge 116, and plurality of handle holding loops 118 mounted on base plate 104. Wrench securing plate assembly 102 comprises base plate 104, and plurality of handle holding loops 118 in combination. Handle holding loops 118 are sized to accommodate wrench 122; wrench 122 comprises a pipe-wrench and may also hold other forms of wrench, as per specific work application. Parameters of base plate 104 are defined by top side 106, bottom side 108, first edge 110, second edge 112, third edge 114, and fourth edge 116. Top side 106 and bottom side 108 are planer; bottom side 108 of base plate 104 is able to be set on a flat surface for use. Wrench securing plate system 100 further comprises apertures 120 in preferred embodiments for securing base plate 104 to another surface or for hanging the device on a bench or the like for storage. Base plate 104 preferably comprises dimensions of about 8 inches wide and about 12 inches long and about 0.0793 inches thick. Other dimensions may be used; however the mentioned dimensioned are preferred for ease during work and for storage.

Figure 2:
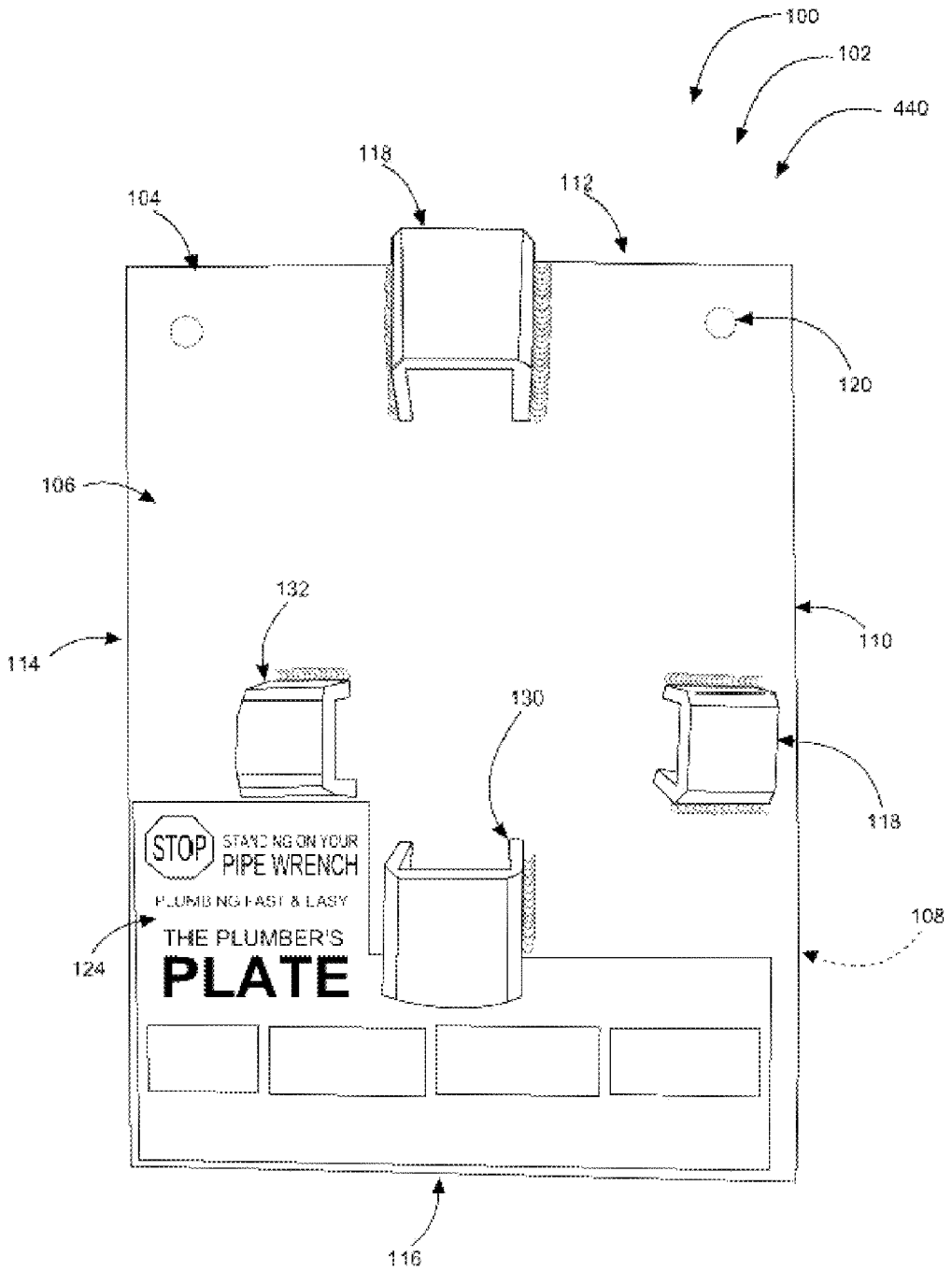
FIG. 2 is a top view illustrating a wrench securing plate assembly of the wrench securing plate system according to an embodiment of the present invention of FIG. 1.

FIG. 2 is a top view illustrating wrench securing plate assembly 102 of wrench securing plate system 100 according to an embodiment of the present invention of FIG. 1.

A plurality of handle holding loops 118 are strategically mounted to top side 106 of base plate 104, (preferably welded, but may be stamped); wrench securing plate assembly 102 is useful for holding wrench 122 in stasis via securing a handle of wrench 122 within at least two of handle holding loops 118 such that a user is able to manipulate a workpiece using wrench 122 yet not having to hold wrench 122. First set of at least two of handle holding loops 118 preferably comprises dimensions of about 1.055 inches wide and 1½ inches long and 1.800 inches tall and 0.0793 inches thick. Second set of at least two of handle holding loops 118 preferably comprises dimensions of about 0.885 inches wide and 1 inch long and 1.380 inches tall and 0.0793 inches thick. Plurality of handle holding loops 118 may comprise ferrous material or other suitably durable material. Wrench securing plate system 100 further has a set of user-instructions 124 for use providing a functional indicia within ready view of the user to increase safety and ease of use.

Figure 3:
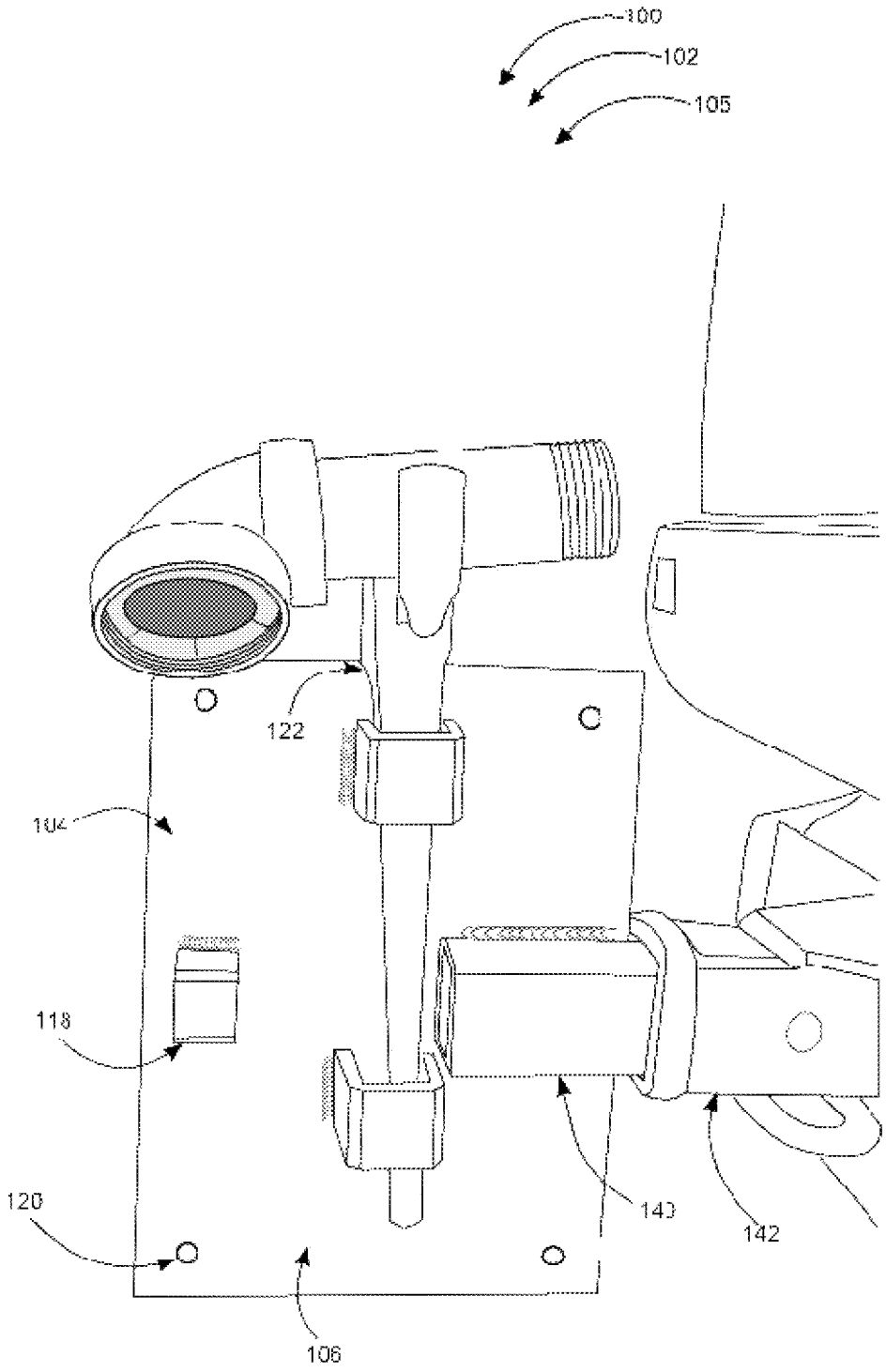
FIG. 3 is a side view illustrating the wrench securing plate assembly comprising a receiver hitch adapter which is able to be received by a hitch receiver on a vehicle according to an embodiment of the present invention of FIG. 1.

Referring now to FIG. 3, a side view illustrating wrench securing plate assembly 102 comprising receiver hitch adapter 140 which is able to be received by hitch receiver 142 on a vehicle according to an embodiment of the present invention of FIG. 1.

Wrench securing plate assembly 102 further comprises a first set of (at least two of) handle holding loops 118 fixably mounted to top side 106 of base plate 104 of wrench securing plate assembly 102 such that a handle of a large wrench is able to be held in stasis. A second set of (at least two of) handle holding loops 118 are also fixably mounted to top side 106 of wrench securing plate assembly 102 such that handle of a small wrench may be held in stasis. First set of handle holding loops 118 is mounted perpendicularly to second set of handle holding loops 118 on top side 106 of wrench securing plate assembly 102. Handle holding loops 118 comprise a 3-D rectangular profile in preferred embodiments. When in the 2 inch hitch adapter, the wrench securing plate system 100 is used as a step with grip tape on the flat surface.

In another embodiment, handle holding loops 118 do not comprise a 3-D rectangular profile, they may comprise rounded loops or other such shapes as particular to the wrench being held. Wrench securing plate system 100 further comprises a bottom surface located on bottom side 108, bottom surface is substantially planar, thereby allowing wrench securing plate assembly 102 to be set securely on a flat surface such as a work bench, table or the like.

Wrench securing plate system 100 may further comprise a receiver hitch adapter 140, as shown. Receiver hitch adapter 140 is able to be received by a hitch receiver 142 on a vehicle such that wrench securing plate assembly 102 is able to provide a worksite at (behind) vehicle. Receiver hitch adapter 140 is able to be received by a hitch receiver on a vehicle such that wrench securing plate assembly 102 is oriented in a vertical positioning (shown) for work. By rotating the device the workpiece may be worked on in a horizontal position as well (shown in FIG. 1).

Figure 4A:
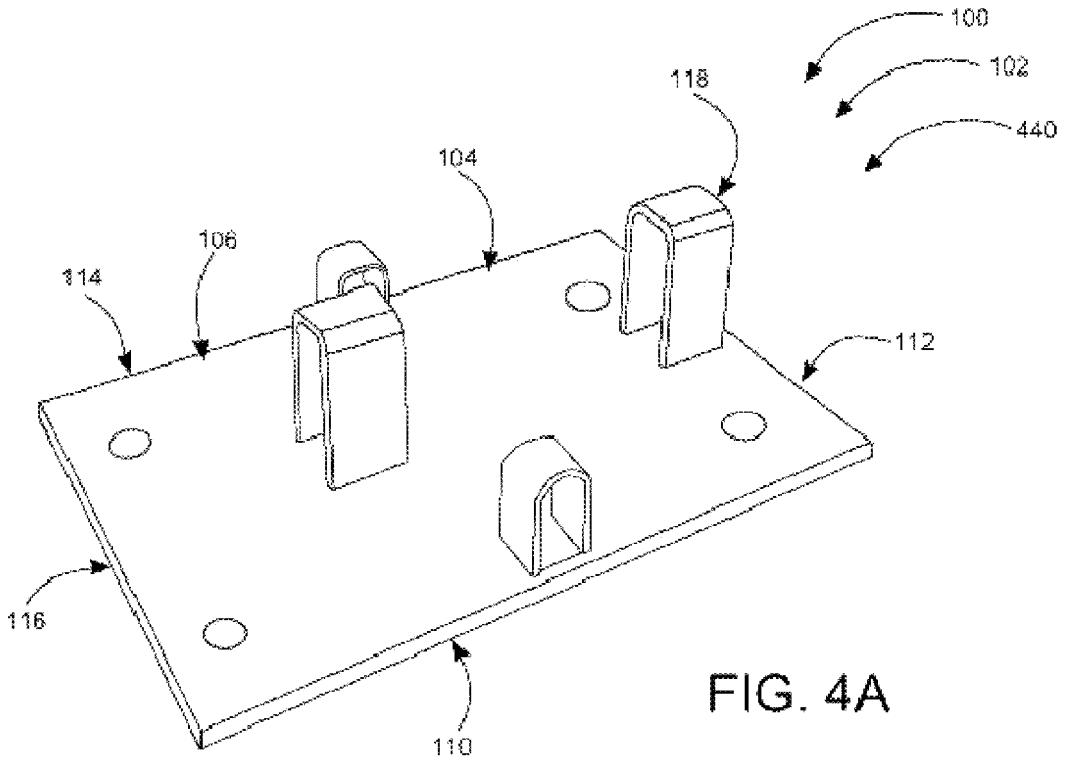
FIG. 4A is a perspective view illustrating the wrench securing plate assembly with a plurality of handle holding loops (3-D rectangular profile) according to an embodiment of the present invention of FIG. 1.
Figure 4B:
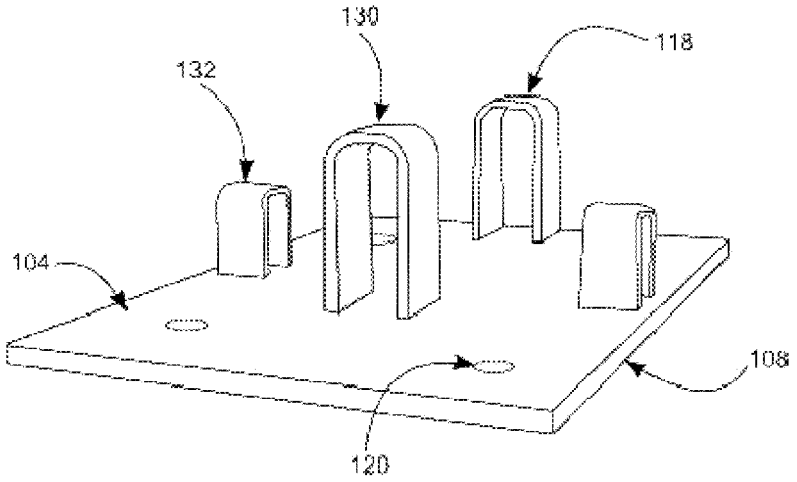
FIG. 4B is another perspective view illustrating a relationship between handle holding loops (non-3-D rectangular profile) comprising a first set of the handle holding loops mounted perpendicularly to a second set of the handle holding loops as mounted on a top side of a base plate of the wrench securing plate assembly according to an embodiment of the present invention of FIG. 1.

Referring now to FIGS. 4A and 4B; FIG. 4A showing a perspective view illustrating wrench securing plate assembly 102 with a plurality of handle holding loops 118 (3-D rectangular profile); FIG. 4B showing another perspective view illustrating a relationship between handle holding loops 118 (non-3-D rectangular profile) comprising a first set 130 of the handle holding loops 118 mounted perpendicularly to a second set 132 of handle holding loops 118 as mounted on top side 106 of base plate 104 of wrench securing plate assembly 102 both figures according to an embodiment of the present invention of FIG. 1.

Wrench securing plate system system 100 may be sold as kit 440 comprising the following parts: at least one wrench securing plate assembly 102; and at least one set of user instructions located on base plate 104 for ease of viewing. Wrench securing plate system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different loop combinations, parts may be sold separately, etc., may be sufficient.

Figure 5:
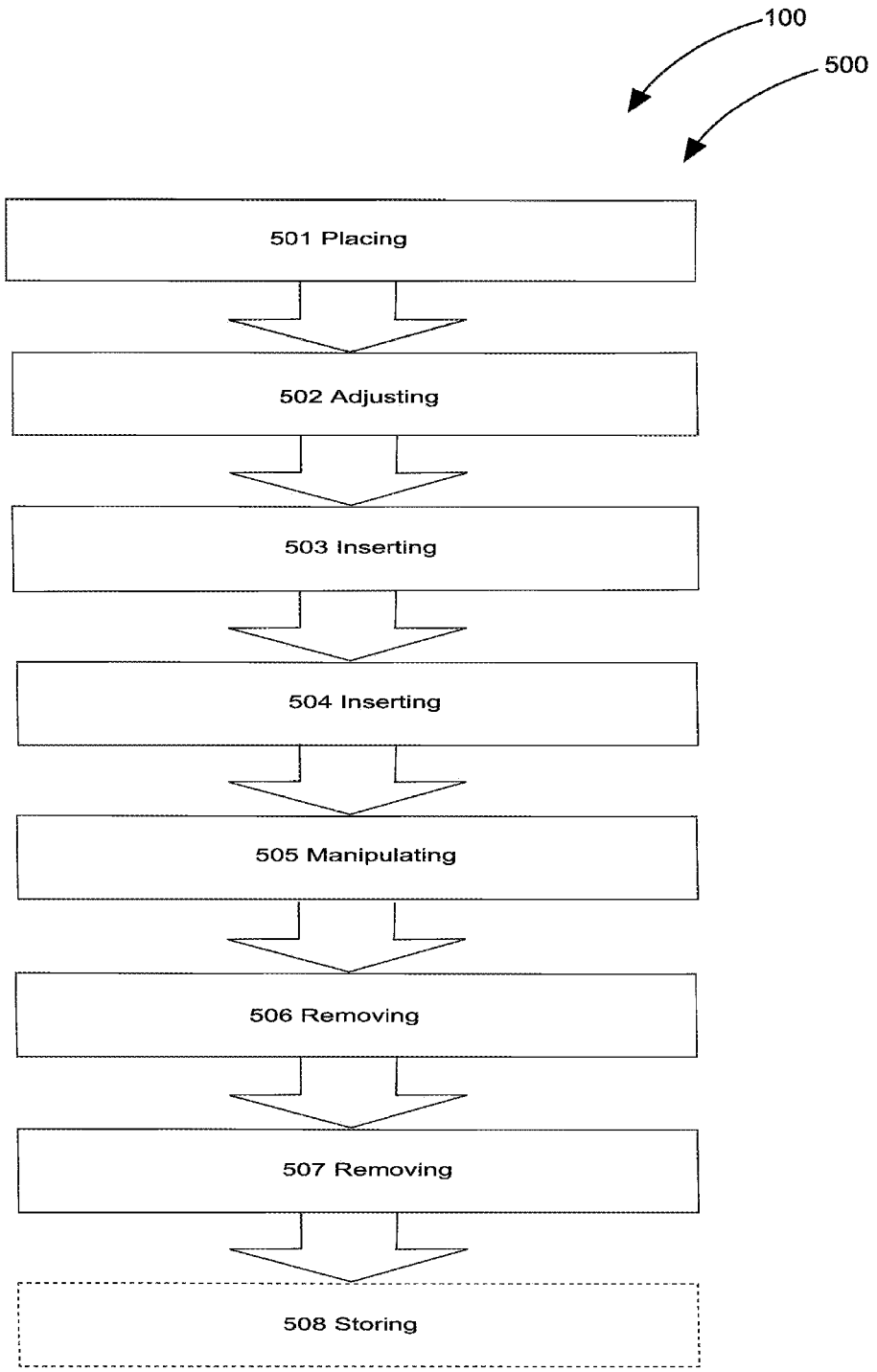
FIG. 5 is a flowchart illustrating a method of use for the wrench securing plate system according to an embodiment of the present invention of FIGS. 1-4B.

Referring now to FIG. 5, a flowchart illustrating a method of use 500 of wrench securing plate system 100 according to an embodiment of the present invention of FIGS. 1-4B.

Method of use 500 for a wrench securing plate system 100 comprises the steps of: step one 501 placing a wrench securing plate assembly 102 on a flat planer surface, step two 502 adjusting the jaw opening of the pipe wrench (wrench 122), step three 503 inserting a pipe wrench (wrench 122) into handle holding loops 118, step four 504 inserting a workpiece into the jaw opening, step five 505 manipulating the workpiece, step six 506 removing the workpiece, step seven 507 removing the pipe wrench (wrench 122) from the handle holding loop(s) 118, and step eight 508 storing the wrench securing plate assembly 102.

It should be noted that step 508 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A combination of a wrench set, a wrench set securing plate system, and a trailer hitch, said combination comprising:

a trailer hitch adapted to be removably connected between the back end of a vehicle and a base plate of a wrench set securing plate assembly;

a wrench set including two wrenches, wherein the two wrenches comprise a first larger wrench and a second smaller wrench, and wherein a handle of the larger wrench is longer in length than a handle of the smaller wrench; and a wrench set securing plate assembly having;

a base plate having;

a top side;

a bottom side;

a first edge;

a second edge;

a third edge; and a fourth edge;

wherein said first, second, third, and fourth edges form a rectangular shape; and a plurality of handle holding loops;

a plurality of apertures for securing said base plate to another surface;

wherein said top side and said bottom side are planer;

wherein said bottom side of said base plate is able to be set on a flat surface for use;

wherein said plurality of handle holding loops are mounted to said top side of said base plate;

wherein said wrench securing plate assembly is adapted to hold each said two wrenches in stasis via respective two of said handle holding loops such that a user is able to manipulate a workpiece using a respective said wrench yet not having to hold said wrench;

wherein said wrench securing plate assembly further comprises a first set of two of said handle holding loops fixably mounted to said top side of said wrench securing plate such that said handle of a said larger wrench is able to be held in stasis between said first set of two handle holding loops;

wherein said wrench securing plate assembly further comprises a second set of two of said handle holding loops fixably mounted to said top side of said wrench securing plate such that said handle of a said smaller wrench may be held in stasis between said second set of two handle holding loops;

wherein said first set of said handle holding loops are positioned and oriented perpendicularly to said second set of said handle holding loops on said top side of said wrench securing plate assembly, such that said smaller wrench can be held in stasis at a 90 degree angle to that of said larger wrench;

and wherein the distance between the handle holding loops of said first set of said handle holding loops is larger than the distance between the handle holding loops of said second set of said handle holding loops, to thereby be adapted to facilitate the difference in size between said handle of said larger wrench and said handle of said smaller wrench; and wherein one of said handle holding loops of said second set of two of said handle holding loops is shaped to removably secure one end of said trailer hitch, such that when said trailer hitch is connected between the back end of said vehicle and the base plate of said wrench set securing plate assembly, said wrench set securing plate assembly is secured in place and provides a stable support for said larger wrench to be placed between said first set of two of said handle holding loops and be ready to be used to manipulate a workpiece.

* * * * *